US009699845B2

(12) United States Patent
Hagino

(10) Patent No.: US 9,699,845 B2
(45) Date of Patent: Jul. 4, 2017

(54) CONTROL CIRCUIT AND CONTROL METHOD FOR ILLUMINATION APPARATUS

(71) Applicant: ROHM CO., LTD., Ukyo-Ku, Kyoto (JP)

(72) Inventor: Junichi Hagino, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/190,904

(22) Filed: Jun. 23, 2016

(65) Prior Publication Data

US 2016/0381748 A1 Dec. 29, 2016

(30) Foreign Application Priority Data

Jun. 23, 2015 (JP) ..... 2015-125801

(51) Int. Cl.

| | |
|---|---|
| ***H05B 37/02*** | (2006.01) |
| ***H05B 33/08*** | (2006.01) |
| ***G09G 3/34*** | (2006.01) |
| *G09G 3/36* | (2006.01) |

(52) U.S. Cl.

CPC ..... *H05B 33/0815* (2013.01); *G09G 3/342* (2013.01); *H05B 33/083* (2013.01); *H05B 33/0845* (2013.01); *G09G 3/36* (2013.01); *G09G 2310/06* (2013.01); *G09G 2320/0247* (2013.01); *G09G 2320/0252* (2013.01); *G09G 2320/064* (2013.01); *G09G 2320/0693* (2013.01); *G09G 2330/021* (2013.01)

(58) Field of Classification Search

CPC ..... H05B 33/0815; H05B 33/083; H05B 33/0845; G09G 3/342

See application file for complete search history.

(56) References Cited

U.S. PATENT DOCUMENTS

| | | | | |
|---|---|---|---|---|
| 2009/0230874 | A1* | 9/2009 | Zhao | H05B 33/0827 315/192 |
| 2009/0230891 | A1* | 9/2009 | Zhao | H05B 33/0815 315/308 |
| 2009/0237007 | A1* | 9/2009 | Leng | H05B 33/0815 315/297 |

(Continued)

FOREIGN PATENT DOCUMENTS

| | | |
|---|---|---|
| JP | 2002252971 A | 9/2002 |
| JP | 2003157986 A | 5/2003 |

(Continued)

*Primary Examiner* — Tung X Le
*Assistant Examiner* — Raymond R Chai
(74) *Attorney, Agent, or Firm* — Cantor Colburn LLP

(57) ABSTRACT

An error signal generating unit is configured such that (i) in a calibration period, the error signal generating unit is set to a first state in which it amplifies an error signal by amplifying a difference between a predetermined first reference voltage and the lowest one from among multiple first detection voltages, and such that (ii) after the calibration period, the error signal generating unit is set to a second state in which it generates the error signal by amplifying a difference between a second detection voltage and a second reference voltage. A reference voltage setting unit holds, as the second reference voltage, the largest value of the second detection voltage detected in the calibration period.

20 Claims, 9 Drawing Sheets

(56) References Cited

U.S. PATENT DOCUMENTS

| | | | | |
|---|---|---|---|---|
| 2010/0289424 | A1* | 11/2010 | Chang | H05B 33/0818 315/250 |
| 2010/0327772 | A1* | 12/2010 | Lee | H05B 33/0818 315/297 |
| 2012/0074856 | A1* | 3/2012 | Takata | H05B 33/0815 315/192 |
| 2012/0248997 | A1* | 10/2012 | Jung | H05B 33/0815 315/192 |
| 2012/0280632 | A1* | 11/2012 | Kim | H05B 33/0815 315/192 |
| 2014/0139131 | A1* | 5/2014 | Park | H05B 33/0818 315/210 |
| 2014/0168567 | A1* | 6/2014 | Kikuchi | H05B 33/0815 349/61 |
| 2015/0061499 | A1* | 3/2015 | Hattrup | H05B 33/0815 315/122 |

FOREIGN PATENT DOCUMENTS

| | | | |
|---|---|---|---|
| JP | 2004032875 | A | 1/2004 |
| JP | 2007028784 | A | 2/2007 |
| JP | 2007173813 | A | 7/2007 |

* cited by examiner

CONTROL CIRCUIT AND CONTROL METHOD FOR ILLUMINATION APPARATUS

CROSS REFERENCE TO RELATED APPLICATIONS

The present invention claims priority under 35 U.S.C. §119 to Japanese Application No. 2015-125801, filed Jun. 23, 2015, the entire content of which is incorporated herein by reference.

BACKGROUND OF THE INVENTION

Field of the Invention

The present invention relates to a driving technique for a light-emitting diode.

Description of the Related Art

As a backlight for a liquid crystal display (LCD) panel, white light-emitting diodes (which will be simply referred to as "LEDs" hereafter) having favorable properties from the perspective of a long operating life, low power consumption, and a wide color range are employed.

FIG. 1 is a diagram showing a backlight illumination apparatus 2*r* investigated by the present inventors. FIG. 1 shows an LCD panel 102 in addition to the illumination apparatus 2*r*. The illumination apparatus 2*r* is configured as a direct-type illumination apparatus. The illumination apparatus 2*r* includes: LED bars (which will also be referred to as the "LED strings") 10_1 through 10_4 respectively provided to multiple channels CH1 through CH4 on the back face of the LCD panel 102; and a multi-channel driving circuit 20 that drives the LED bars 10_1 through 10_4.

Each LED bar 10 includes multiple LEDs connected in series. The LCD panel 102 has multiple regions 104_1 through 104_4, which are vertically divided along a first direction. The multiple LED bars 10_1 through 10_4 are provided to the multiple regions 104_1 through 104_4, respectively. Specifically, the LED bar 10_i of the i-th channel CHi is arranged on the back face of the LCD panel 102 such that it is assigned to the corresponding i-th region 104_i.

The driving circuit 20 includes multiple current drivers 22_1 through 22_4, a DC/DC converter 24, and a control circuit 26. The current drivers 22_1 through 22_4 are each provided to the corresponding channel, and are directly connected to the corresponding LED bars 10_1 through 10_4, respectively. The luminance of the LED bar 10 of each channel is controlled according to a driving current $I_{LED}$ generated by the corresponding current driver 22.

A DC/DC converter 24 supplies a driving voltage $V_{OUT}$ across both ends of each channel of the LED bar 10 and the current driver 22. The control circuit 26 controls the DC/DC converter 24 so as to stabilize the driving voltage $V_{OUT}$ to a level that allows the LED bar 10 of each channel to emit light with desired luminance Furthermore, the control circuit 26 controls a driving current $I_{LED}$ generated by the current drivers 22_1 through 22_4.

There are two known methods for controlling the luminance of a backlight LED, i.e., a current dimming (analog dimming) control method and a PWM dimming (pulse dimming) control method. With the current dimming control method, the current value of the driving current $I_{LED}$ that flows through the LED bar 10 is controlled. With the PWM dimming control method, the driving current $I_{LED}$ is switched on and off with a frequency from several dozen to several hundred Hz so as to adjust the time ratio (duty ratio) between the on period in which the flow of the driving current $I_{LED}$ is supplied and the off period in which the flow of the driving current $I_{LED}$ is suspended. Such an arrangement is capable of adjusting the effective luminance of each LED bar 10.

FIG. 2 is a circuit diagram showing an illumination apparatus 2*r* according to a conventional technique. A control circuit 26 (200*r*) according to such a conventional technique includes an error amplifier 202, a pulse width modulator 204, a driver 206, and a dimming controller 210. The cathode voltages (which will also be referred to as the "detection voltages") $V_{LED1}$ through $V_{LEDN}$ of multiple respective LED bars 10_N are fed back to the control circuit 200*r*. The cathode voltage $V_{LED}$ of each channel corresponds to the voltage across both ends of the corresponding current driver 22.

The error amplifier 202 amplifies the difference between the lowest voltage from among the multiple cathode voltages $V_{LED1}$ through $V_{LEDN}$ and a predetermined reference voltage $V_{REF}$. The pulse width modulator 204 generates a pulse signal $S_{PWM}$ having a duty ratio that corresponds to an error voltage $V_{ERR}$ received from the error amplifier 202. The driver 206 switches on and off the DC/DC converter 24 according to the pulse signal $S_{PWM}$.

The dimming controller 210 instructs the current driver 22 of each channel to generate the driving current $I_{LED}$ with a current value that is changed according to the target luminance set for the corresponding LED bar 10 (analog dimming control method). Furthermore, the dimming controller 210 instructs the current driver 22 of each channel to generate the driving current $I_{LED}$ with a time ratio that is changed according to the target luminance set for the corresponding LED bar 10 (PWM dimming control method).

In a case in which the PWM dimming control operation is performed, when a given channel is in the off state, that channel is excluded from the candidates used by the error amplifier 202 to perform the feedback control operation. That is to say, the error amplifier 202 uses only the channels in the on state as the candidates to perform the feedback control operation. With such an arrangement, the cathode voltage $V_{LED1}$ of the i-th channel is represented by the following Expression.

$$V_{LED1}=V_{OUT}-V_{Fi}$$

Here, $V_{Fi}$ represents the forward voltage $V_{Fi}$ of the LED bar 10_i of the i-th channel. That is to say, with the illumination apparatus 2*r* shown in FIG. 2, the channel that provides the lowest cathode voltage $V_{LED}$, i.e., the channel of the LED bar 10 with the highest voltage drop (forward voltage $V_F$), is used to perform the feedback control operation. Thus, the output voltage $V_{OUT}$ of the DC/DC converter 24 is stabilized to a value represented by the following Expression.

$$V_{OUT}=V_{REF}+V_{F_MAX}.$$

Here, $V_{F_MAX}$ represents the highest forward voltage $V_F$ from among the on-state channels.

In order to provide an image with a wide dynamic range of luminance, an advanced display apparatus supports an individual area dimming control function. In the individual area dimming control operation, when a given LED bar 10 is to provide the corresponding region 104 with a high luminance, the LED bar 10 emits light with a high on-time ratio (high duty ratio) according to an image to be displayed on the LCD panel 102. Conversely, when a given LED bar 10 is to provide the corresponding region 104 with a low luminance, the LED bar 10 emits light with a low on-time ratio (low duty ratio). FIG. 3 is an operation waveform diagram showing the operation of the control circuit 200*r* in a case in which it performs such an individual area dimming control operation.

The current driver 22 of each channel switches on and off with a duty ratio that is dynamically and adaptively changed according to an image to be displayed on the LCD panel 102. With such an arrangement, in some cases, there is a large difference in the forward voltage $V_F$ among the LED bars 10 due to variation in the elements of the multiple LEDs that form each LED bar 10. Description will be made regarding an example including four channels of LED bars 10 assuming that the relation $V_{F1}>V_{F2}>V_{F3}>V_{F4}$ holds true. In FIG. 3, the PWMi signal (i=1, 2, 3, 4) represents the on state (high level) and the off state (low level) for the i-th channel.

As shown in FIG. 3, with the illumination apparatus 2*r* shown in FIG. 2, the DC/DC converter 24 outputs the output voltage $V_{OUT}$, which changes with time according to the PWM signal. As the difference between the forward voltages $V_{F1}$ through $V_{F4}$ of the multiple respective channels becomes larger, the range in which the output voltage $V_{OUT}$ changes becomes larger.

When the channel used to perform the feedback control operation is switched from a channel at which the forward voltage $V_F$ is low to another channel at which the forward voltage $V_F$ is high, the output voltage $V_{OUT}$ is raised. However, in a case in which the rising rate of the output voltage $V_{OUT}$ is insufficient, the voltage $V_{LED}$ across both ends of the current driver 22 is lower than that required for the channel at which the forward voltage $V_F$ is large. In this state, such a current driver 22 is not able to supply a sufficient driving current $I_{LED}$, leading to a reduction in the luminance provided by the LED bar 10 of this channel. Such a reduction in the luminance is recognized by viewers as screen flicker, which is a problem.

In order to solve such a problem, the control circuit 200*r* is required to have an improved response speed. In order to support such a high response speed, there is a need to raise the switching frequency for the DC/DC converter 24. However, this leads to a problem of increased power consumption and increased heat generation. Furthermore, in a case in which the feedback loop has a wide bandwidth, this leads to degraded phase characteristics, resulting in a reduction in the stability of the feedback loop. Moreover, in a case in which the output voltage $V_{OUT}$ is changed at a high rate, such an arrangement leads to a problem of noise generation from ceramic capacitors, coils, or the like.

Such problems are not restricted to such a backlight illumination apparatus 2*r*, but can occur in various kinds of illumination apparatuses for various kinds of usages.

SUMMARY OF THE INVENTION

The present invention has been made in order to solve such problems. Accordingly, it is an exemplary purpose of an embodiment of the present invention to provide an illumination apparatus or a control circuit for such an illumination apparatus which is capable of solving such problems that can occur in a case in which the on/off operations of multiple channels of light-emitting elements are independently controlled.

An embodiment of the present invention relates to a control circuit for an illumination apparatus. The illumination apparatus comprises: a switching converter that generates an output voltage at its output line; multiple light-emitting elements each having one end connected to the output line of the switching converter; multiple current drivers that respectively correspond to the multiple respective light-emitting elements, and each of which is connected to the other end of a corresponding light-emitting element; and the control circuit that controls the switching converter based on multiple first detection voltages each of which occurs at the other end of the corresponding one of the multiple light-emitting elements and a second detection voltage that corresponds to the output voltage at the output line. The control circuit comprises: an error signal generating unit configured such that (i) in a calibration period, the error signal generating unit is set to a first state in which a difference between a predetermined first reference voltage $V_{REF1}$ and the lowest from among the multiple first detection voltages is amplified so as to generate an error signal, and such that (ii) after the calibration period ends, a difference between the second detection voltage and a second reference voltage $V_{REF2}$ is amplified so as to generate the error signal; a pulse modulator that generates a pulse signal according to the error signal; a driver that drives the switching converter according to the pulse signal; a dimming controller that generates multiple pulse modulated dimming pulses, so as to control on/off operations of the multiple current drivers according to the multiple dimming pulses; and a reference voltage setting unit that determines the second reference voltage according to the largest value of the second detection voltage detected in the calibration period.

With the largest voltage from among the multiple voltage drops (forward voltages) that occur at the multiple light-emitting elements as $V_{F_MAX}$, in the calibration period, the maximum value $V_{OUT_MAX}$ of the output voltage $V_{OUT}$ is represented by $V_{OUT_MAX}=V_{REF1}+V_{F_MAX}$. In this stage, the second detection voltage that corresponds to the maximum value $V_{OUT_MAX}$ is held as the second reference voltage $V_{REF2}$. This allows the output voltage to be stabilized to the output voltage $V_{OUT_MAX}$ even after the calibration period. The output voltage $V_{OUT_MAX}$ matches the lower limit of the voltage range that allows all the channels of light-emitting elements to be turned on in a sure manner.

With such an embodiment, the output voltage $V_{OUT}$ is maintained at a substantially constant level during the normal lighting period. Thus, such an arrangement allows the response speed required by the control circuit to be reduced, thereby solving at least one of the aforementioned problems.

With an embodiment, in the calibration period, the dimming controller may generate multiple dimming pulses each having a duty ratio that provides the corresponding light-emitting element with a maximum forward voltage.

When a voltage having a narrow pulse width is applied to a light-emitting element such as an LED, the voltage (forward voltage) across both ends thereof is higher than the forward voltage $V_F$ thereof when it operates in a steady state (static state). The present embodiment is effectively applicable to such an arrangement employing such a light-emitting element.

With an embodiment, in the calibration period, the dimming controller may generate the multiple dimming pulses so as to turn on the multiple light-emitting elements at the same time.

In this case, the second detection voltage may preferably be sampled and held in a period in which the multiple light-emitting elements are turned on at the same time. Such an arrangement allows the reference voltage setting unit to have a simple configuration.

With an embodiment, after the calibration period ends, the error signal generating unit may be switchable between the first state and the second state.

In a case in which there is a small fluctuation in the output voltage $V_{OUT}$ if the first state is selected after the calibration period, i.e., in the normal lighting period, the error signal generating unit is instructed to operate in the first state, thereby providing improved efficiency.

With an embodiment, after the calibration period ends, the error signal generating unit may be selectively set to one from among the first state and the second state according to the duty ratios of the multiple dimming pulses.

With an embodiment, when the smallest duty ratio from among the duty ratios of the multiple dimming pulses is larger than a predetermined threshold value, the error signal generating unit may be set to the first state. Conversely, when the smallest duty ratio is smaller than the threshold value, the error signal generating unit may be set to the second state.

With an embodiment, the error signal generating unit may comprise: a first error amplifier that amplifies a difference between the first reference voltage and the lowest voltage from among the multiple first detection voltages, so as to generate a first error signal; a second error amplifier that amplifies a difference between the second detection voltage and the second reference voltage, so as to generate a second error signal; and a selector that receives the first error signal and the second error signal, that selects the first error signal in the calibration period, and that selects the second error signal after the calibration period ends.

Another embodiment of the present invention also relates to a control circuit for an illumination apparatus. The illumination apparatus comprises: a switching converter that generates an output voltage at its output line; multiple light-emitting elements each having one end connected to the output line of the switching converter; multiple current drivers that respectively correspond to the multiple respective light-emitting elements, and each of which is connected to the other end of a corresponding light-emitting element; and the control circuit that controls the switching converter based on multiple first detection voltages each of which occurs at the other end of the corresponding one of the multiple light-emitting elements and a second detection voltage that corresponds to the output voltage at the output line. The control circuit comprises: an error signal generating unit that is switchable between (i) a first state in which a difference between a predetermined first reference voltage and the lowest from among the multiple first detection voltages is amplified so as to generate an error signal, and (2) a second state in which a difference between the second detection voltage and a second reference voltage is amplified so as to generate the error signal; a pulse modulator that generates a pulse signal according to the error signal; a driver that drives the switching converter according to the pulse signal; and a dimming controller that generates multiple pulse modulated dimming pulses, so as to control on/off operations of the multiple current drivers according to the multiple dimming pulses. In a normal lighting period, the error signal generating unit is selectively set to one from among the first state and the second state according to the duty ratios of the multiple dimming pulses.

With such an embodiment, in a case in which there is a small fluctuation in the output voltage $V_{OUT}$ if the first state is selected, the operation is performed in the first state, thereby providing improved efficiency. Conversely, in a case in which there is a large fluctuation in the output voltage $V_{OUT}$ or otherwise the output voltage $V_{OUT}$ fluctuates with a high rate if the first state is selected, the operation is performed in the second state. This prevents a situation in which a light-emitting element cannot turn on due to a response delay.

With an embodiment, when the smallest duty ratio from among the duty ratios of the multiple dimming pulses is larger than a predetermined threshold value, the error signal generating unit may be set to the first state. Conversely, when the smallest duty ratio is smaller than the threshold value, the error signal generating unit may be set to the second state.

With an embodiment, (i) in a calibration period, the error signal generating unit may be set to the first state. Also, the control circuit may further comprise a reference voltage setting unit that holds, as the second reference voltage, the largest value of the second detection voltage detected in the calibration period.

With an embodiment, the control circuit may be monolithically integrated on a single semiconductor substrate.

Examples of such a "monolithically integrated" arrangement include: an arrangement in which all the circuit components are formed on a semiconductor substrate; and an arrangement in which principal circuit components are monolithically integrated. Also, a part of the circuit components such as resistors and capacitors may be arranged in the form of components external to such a semiconductor substrate in order to adjust the circuit constants. By monolithically integrating the circuit on a single chip, such an arrangement allows the circuit area to be reduced, and allows the circuit elements to have uniform characteristics.

Yet another embodiment of the present invention relates to an illumination apparatus. The illumination apparatus comprises any one of the aforementioned control circuits.

Also, the multiple light-emitting elements may each be configured as a light-emitting diode string comprising multiple light-emitting diodes connected in series.

Also, the illumination apparatus may be configured as a backlight for a liquid crystal panel.

Yet another embodiment of the present invention relates to a display apparatus. The display apparatus comprises a liquid crystal panel and any one of the aforementioned illumination apparatuses.

It is to be noted that any arbitrary combination or rearrangement of the above-described structural components and so forth is effective as and encompassed by the present embodiments. Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A is indirectly connected to the member B via another member that does not affect the electric connection therebetween, in addition to a state in which the member A is physically and directly connected to the member B.

Similarly, the state represented by the phrase "the member C is provided between the member A and the member B" includes a state in which the member A is indirectly connected to the member C, or the member B is indirectly connected to the member C via another member that does not affect the electric connection therebetween, in addition to a state in which the member A is directly connected to the member C, or the member B is directly connected to the member C.

Figure 4:
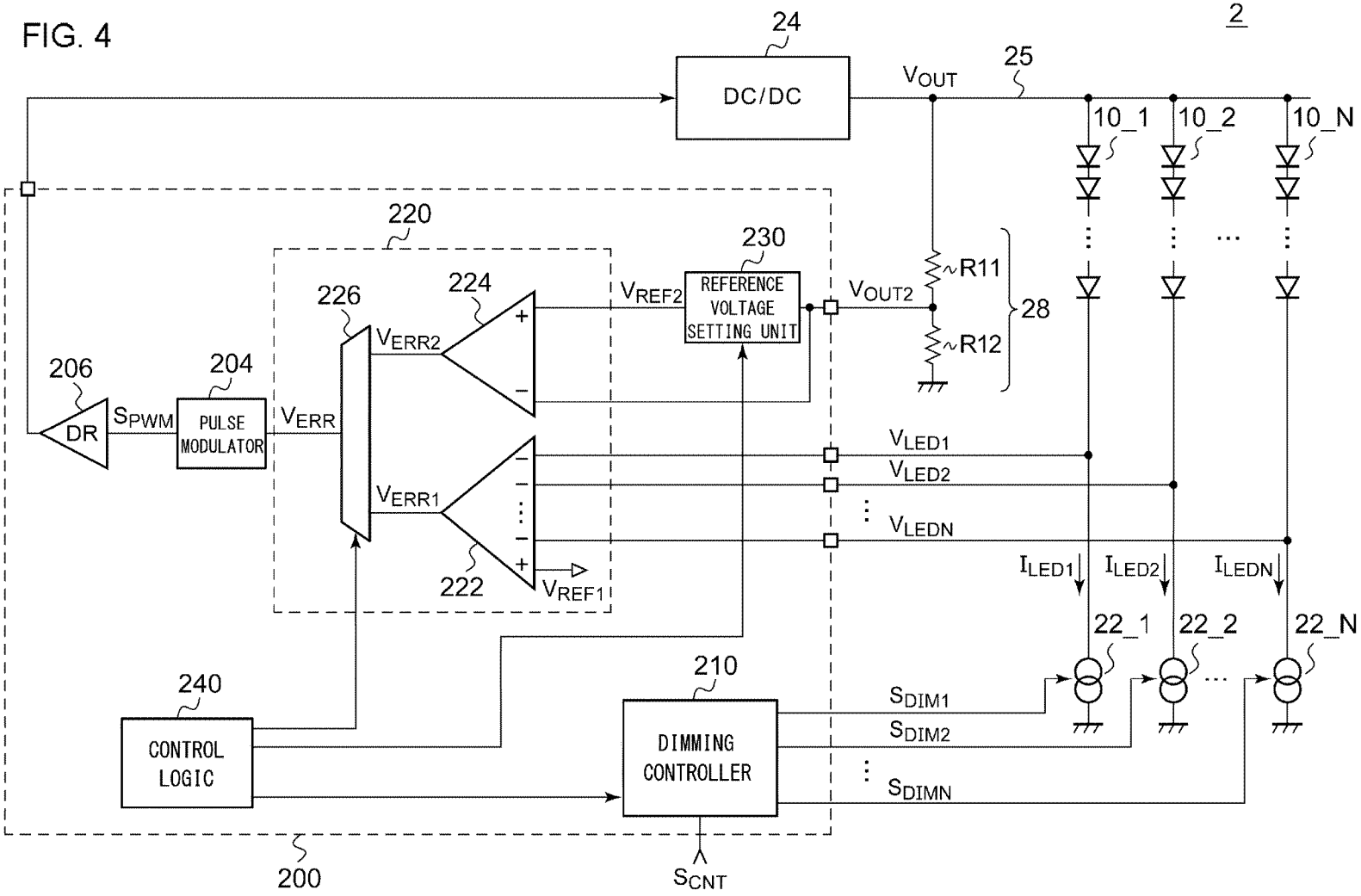
FIG. 4 is a circuit diagram showing an illumination apparatus including a control circuit according to an embodiment.

FIG. 4 is a circuit diagram showing an illumination apparatus 2 including a control circuit 200 according to an embodiment. The illumination apparatus 2 includes multiple LED bars 10_1 through 10_N (N represents an integer of 2 or more), multiple current drivers 22_1 through 22_N, a DC/DC converter (switching converter) 24, a feedback circuit 28, and a control circuit 200.

The DC/DC converter 24 generates an output voltage $V_{OUT}$ at its output line 25. The configuration of the DC/DC converter 24 is not restricted in particular. Specifically, as such a DC/DC converter 24, a switching converter having a suitable topology may preferably be selected according to the usage, from among a step-up converter (boost converter), step-down converter (buck converter), step-up/step-down converter, flyback converter, forward converter, and the like.

Each LED bar 10 is configured as a light-emitting element that emits light according to a driving current. Each LED bar 10 includes multiple LEDs connected in series. One end (anode) of each LED bar 10 is connected to the output line 25. The current driver 22 is provided for each channel, and is connected to the other end (cathode) of the corresponding LED bar 10. The luminance (light amount) provided by the LED bar 10 of each channel is controlled according to a driving current $I_{LED}$ generated by the corresponding current driver 22.

The feedback circuit 28 generates a second detection voltage $V_{OUT2}$ that corresponds to the output voltage $V_{OUT}$ at the output line 25. The output voltage $V_{OUT}$ itself may be employed as the second detection voltage $V_{OUT2}$. Also, the second detection voltage $V_{OUT2}$ may be obtained by dividing the output voltage $V_{OUT}$. Also, the second detection voltage $V_{OUT2}$ may be obtained by shifting the voltage level of the output voltage $V_{OUT}$. The feedback circuit 28 shown in FIG. 4 is configured as a voltage diving circuit including resistors R11 and R12. In this case, the second detection voltage $V_{OUT2}$ is represented by the following Expression.

$$V_{OUT2}=R12/(R11+R12)\times V_{OUT}$$

The control circuit 200 receives the second detection voltage $V_{OUT2}$ and the multiple first detection voltages $V_{LED1}$ through $V_{LEDN}$ that develop at the respective cathodes of the multiple LED bars 10_1 through 10_N. The control circuit 200 controls the DC/DC converter 24 according to the multiple detection voltages $V_{LED1}$ through $V_{LEDN}$ and the second detection voltage $V_{OUT2}$.

The control circuit 200 includes an error signal generating unit 220, a pulse width modulator 204, a driver 206, a dimming controller 210, a reference voltage setting unit 230, and a control logic 240. The control circuit 200 may be configured as a function IC (Integrated Circuit) integrated on a single semiconductor substrate. A part of or otherwise all of the components of the current drivers 22 may be integrated.

The error signal generating unit 220 is switchable between a first state ϕ1 and a second state ϕ2. In the calibration period, the error signal generating unit 220 is set to the first state ϕ1. In the first state ϕ1, the error signal generating unit 220 amplifies the difference between a first reference voltage $V_{REF1}$ and the lowest voltage from among the multiple first detection voltages $V_{LED1}$ through $V_{LEDN}$.

In a normal lighting period after the calibration period, the error signal generating unit 220 is set to the second state ϕ2. In the second state ϕ2, the error signal generating unit 220 amplifies the difference between the second detection voltage $V_{OUT2}$ and the second reference voltage $V_{REF2}$, so as to generate the error signal $V_{ERR}$.

The error signal generating unit 220 includes a first error amplifier 222, a second error amplifier 224, and a selector 226, for example. The first error amplifier 222 amplifies the difference between the first reference voltage $V_{REF1}$ and the lowest voltage from among the multiple first detection voltages $V_{LED1}$ through $V_{LEDN}$, so as to generate a first error signal $V_{ERR1}$. An upstream stage of the first error amplifier 222 includes a switch circuit that excludes the first detection voltages detected at the off-state channels from among the multiple first detection voltages $V_{LED1}$ through $V_{LEDN}$, which is not shown in this drawing. Also, the first error amplifier 222 may be configured such that, when all the channels are set to the off state, i.e., during a time period in which all the channels are excluded from the candidates to be used to perform the feedback control operation, it is able to hold its output signal, i.e., the first error signal $V_{ERR1}$.

The second error amplifier 224 amplifies the difference between the second detection voltage $V_{OUT2}$ and the second reference voltage $V_{REF2}$ so as to generate a second error signal $V_{ERR2}$. The selector 226 receives the first error signal $V_{ERR1}$ and the second error signal $V_{ERR2}$. In the calibration period, the selector 226 selects the first error signal $V_{ERR1}$. After the calibration period ends, the selector 226 selects the second error signal $V_{ERR2}$.

The pulse width modulator 204 generates a pulse signal $S_{PWM}$ according to the error signal $V_{ERR}$. The modulation method and the circuit configuration employed in the pulse width modulator 204 are not restricted in particular. Specifically, known techniques such as voltage mode modulation, perk current mode modulation, or average current mode modulation may be employed. The driver 206 drives the switching elements included in the DC/DC converter 24 according to the pulse signal $S_{PWMN}$.

The dimming controller 210 generates multiple pulse-modulated dimming pulses $S_{DIM1}$ through $S_{DIMN}$. The on/off operations of the multiple current drivers 22_1 through 22_N are controlled according to the multiple dimming pulses $S_{DIM1}$ through $S_{DIMN}$, respectively (PWM dimming control operation). Also, in addition to the PWM dimming control operation, the dimming controller 210 may change the amount of current of each of the driving currents $I_{LED1}$ through $I_{LEDN}$ generated by the multiple current drivers 22_1 through 22_N (analog dimming control operation).

In the normal lighting period, the dimming controller 210 receives, from an unshown higher-level processor (which will also be referred to as the "host controller"), control data $S_{CNT}$ which indicates respective target luminance levels to be set for the multiple LED bars 10_1 through 10_N. The data format of the control data $S_{CNT}$ is not restricted in particular. For example, the control data $S_{CNT}$ may include PWM dimming control data which indicates the duty ratio to be set for the PWM dimming control operation for each channel and analog dimming control data which indicates the amplitude of the driving current $I_{LED}$ to be set for each channel. Also, the control data $S_{CNT}$ may include an instruction value which indicates the luminance level to be set for each channel. In this case, the dimming controller 210 may calculate the duty ratio to be set for each channel according to the instruction value set for each channel, so as to generate the dimming pulses $S_{DIM}$.

In the calibration period, the dimming controller 210 generates multiple dimming pulses $S_{DIM1}$ through $S_{DIMN}$ each having a predetermined waveform to be used to be perform the calibration.

When a given amount of the driving current $I_{LED}$ flows through a given LED in a transient manner, the forward voltage $V_F$ is higher than when it flows in a static state even if they have the same amplitude. That is to say, when a predetermined driving current $I_{LED}$ flows through an LED, the forward voltage $V_F$ of the LED changes according to the frequency (period) and the duty ratio of the dimming pulse $S_{DIM}$. Thus, in the calibration period, the dimming controller 210 preferably generates multiple calibration dimming pulses $S_{DIM1}$ through $S_{DIMN}$ having duty ratios that set the forward voltages $V_{F1}$ through $V_{FN}$ of the LED bars 10_1 through 10_N to their maximum values. Also, in the calibration period, the dimming controller 210 may generate the multiple calibration dimming pulses $S_{DIM1}$ through $S_{DIMN}$ so as to turn on the multiple LED bars 10_1 through 10_N at the same time.

The reference voltage setting unit 230 holds, as the second reference voltage $V_{REF2}$, the maximum value of the second detection voltage $V_{OUT2}$ obtained in the calibration period.

The control logic 240 integrally controls the overall operation of the control circuit 200. Specifically, when the illumination apparatus 2 is instructed to start up, after a predetermined period of time elapses, the control logic 240 sets the illumination apparatus 2 to the calibration period. In this calibration period, the control logic 240 instructs the dimming controller 210 to generate the calibration dimming pulses $S_{DIM1}$ through $S_{DIMN}$. In a case in which the control circuit 200 supports the analog dimming control function, the control logic 240 instructs the current drivers 22_1 through 22_N to generate their maximum driving currents $I_{LED1}$ through $I_{LEDN}$ such that the forward voltages $V_F$ of the LED bars 10 become their maximum values. Furthermore, the control logic 240 instructs the reference voltage setting unit 230 to store the maximum value of the second detection voltage $V_{OUT2}$. Moreover, the control logic 240 instructs the error signal generating unit 220 to operate in the first state ϕ1.

When the calibration period ends, the control logic 240 switches to the normal lighting period. In this period, the control logic 240 switches the dimming controller 210 to a normal mode. In this normal mode, the control logic 240 instructs the dimming controller 210 to generate the dimming pulses $S_{DIM1}$ through $S_{DIMN}$ according to the control data $S_{CNT}$. Furthermore, the control logic 240 sets the error signal generating unit 220 to the second state ϕ2. Moreover, the control logic 240 instructs the reference voltage setting unit 230 to generate the second reference voltage $V_{REF2}$.

Figure 5:
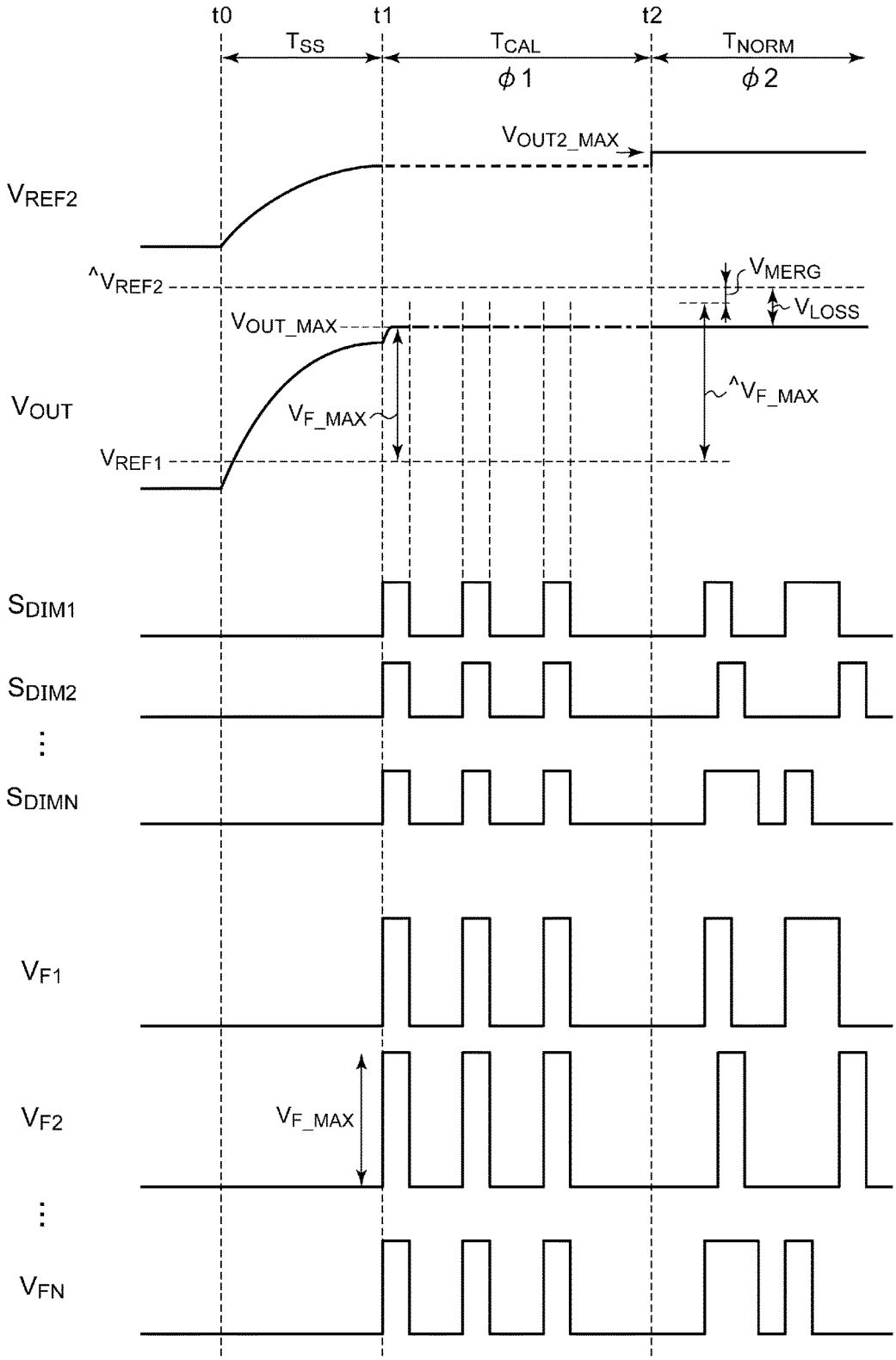
FIG. 5 is an operation waveform diagram showing the operation of the illumination apparatus shown in FIG. 4.

The above is the configuration of the control circuit 200. Next, description will be made regarding the operation thereof. FIG. 5 is an operation waveform diagram showing the operation of the illumination apparatus 2 shown in FIG. 4.

At the time point t0, the illumination apparatus 2 is instructed to start up. The control circuit 200 supports a soft-start function. Specifically, during a soft start period $T_{SS}$ immediately after the start-up operation, the control circuit 200 gradually raises the output voltage $V_{OUT}$ of the DC/DC converter 24 up to a predetermined voltage level. The method for supporting such a soft-start function is not restricted in particular. For example, the error signal generating unit 220 may be operated in the second state ϕ2 using a soft start voltage $V_{SS}$ that is gradually raised instead of using the second reference voltage $V_{REF2}$.

Subsequently, at the time point t1, the illumination apparatus 2 transits to the calibration period $T_{CAL}$. In the calibration period $T_{CAL}$, the error signal generating unit 220 is set to the first state ϕ1. Furthermore, the dimming controller 210 generates the calibration dimming pulses $S_{DIM1}$ through $S_{DIMN}$. The high level of each dimming pulse $S_{DIM}$ corresponds to the on state of the corresponding current driver 22.

The forward voltages $V_{F1}$ through $V_{FN}$ of the multiple LED bars 10_1 through 10_N have pulse waveforms that correspond to the dimming pulses $S_{DIM1}$ through $S_{DIMN}$, and have different respective amplitudes due to variation. In this example, the forward voltage $V_{F2}$ of the second channel exhibits the maximum value $V_{F_MAX}$. Accordingly, the output voltage $V_{OUT}$ of the DC/DC converter 24 is stabilized to a value represented by $V_{OUT_MAX}=V_{REF1}+V_{F_MAX}$.

In the calibration period $T_{CAL}$, the maximum value $V_{OUT2_MAX}$ of the second detection voltage $V_{OUT2}$ is represented by $V_{OUT_MAX}\times R12/(R11+R12)$. The reference voltage setting unit 230 stores the maximum value $V_{OUT2_MAX}$ thus obtained.

At the time point t2, the calibration period $T_{CAL}$ ends. Subsequently, the illumination apparatus 2 transits to the normal lighting period $T_{NORM}$. The reference voltage setting unit 230 generates, as the second reference voltage $V_{REF2}$, the stored voltage $V_{OUT2_MAX}$. Furthermore, the error signal generating unit 220 is set to the second state ϕ2. In this state, a feedback control operation is performed such that the second detection voltage $V_{OUT2}$ matches the second reference voltage $V_{REF2}$ ($=V_{OUT2_MAX}$)). As a result, the output voltage $V_{OUT}$ is stabilized to the same voltage level $V_{OUT_MAX}$ obtained in the calibration period $T_{CAL}$. In the normal lighting period $T_{NORM}$, the dimming controller 210 generates the dimming pulses $S_{DIM1}$ through $S_{DIMN}$ according to the control data $S_{CNT}$.

The above is the operation of the illumination apparatus 2. With the illumination apparatus 2, in the normal lighting period $T_{NORM}$ after the calibration period $T_{CAL}$, the output voltage $V_{OUT}$ is stabilized to the maximum voltage $V_{OUT_MAX}$.

With the illumination apparatus 2, in the normal lighting period, the output voltage $V_{OUT}$ is maintained at a substantially constant level. Thus, such an arrangement is capable of solving at least one of the aforementioned problems. Specifically, such an arrangement provides at least one from among the following effects.

(1) The output voltage $V_{OUT}$ is stabilized within the voltage range that allows all the LED bars 10 to emit light with desired luminance (light amount) levels. That is to say, such an arrangement prevents the output voltage $V_{OUT}$ from becoming insufficient due to a response delay. This prevents the luminance of the LED bar 10 of each channel from becoming lower than the target level. Thus, such an arrangement is capable of suppressing screen flicker or the like.

(2) Furthermore, the output voltage $V_{OUT}$ is maintained at a substantially constant level, thereby suppressing noise that can occur in a ceramic capacitor or a coil due to fluctuation of the output voltage $V_{OUT}$.

(3) Moreover, such an arrangement allows the response speed required by the control circuit 200 to be reduced. With such an arrangement, there is no need to raise the switching frequency. This suppresses an increase in power consumption and an increase in heat generation. Also, with such an arrangement, there is no need to widen the bandwidth of the feedback loop. Thus, such an arrangement provides the system with improved stability.

(4) In addition, the second reference voltage $V_{REF2}$ is determined by the reference voltage setting unit 230, thereby providing the following effect.

As another approach (comparison technique), such a second reference voltage $\hat{V}_{REF2}$ is determined as represented by the following Expression.

$$\hat{V}_{REF2}=V_{REF1}+\hat{V}_{F_MAX}+V_{MERG}$$

Here, $\hat{V}_{F_MAX}$ represents an assumed maximum value of the forward voltage of the LED bar 10 obtained giving consideration to variation. The maximum value of the forward voltage Vf of such a single LED that forms the LED bar 10 can be determined based on the specifications of the LED or otherwise based on measurement results obtained beforehand. Thus, with the number of LEDs included in each LED bar 10 as n, $\hat{V}_{F_MAX}$ is represented by $\hat{V}_{F_MAX}=n\times Vf$. It should be noted that $V_{MERG}$ represents a margin.

With such a comparison technique, in a case in which the actual maximum value $V_{F_MAX}$ from among the forward voltages of the LED bars 10_1 through 10_N is lower than the assumed maximum value $\hat{V}_{F_MAX}=n\times Vf$, the total voltage $V_{LOSS}$, which is the sum of the margin $V_{MERG}$ and the difference ($\hat{V}_{F_MAX}-V_{F_MAX}$), represents voltage loss. As a comparison example, the assumed maximum voltage $\hat{V}_{REF2}$ is shown in FIG. 5.

In contrast, with the control circuit shown in FIG. 4, the reference voltage setting unit 230 sets the second reference voltage $V_{REF2}$ based on the actual values of the forward voltages $V_{F1}$ through $V_{FN}$ of the LED bars 10_1 through 10_N. Thus, such an arrangement provides improved efficiency as compared with such a comparison technique.

The present invention encompasses various kinds of apparatuses and circuits that can be regarded as a block configuration or a circuit configuration shown in FIG. 4, or otherwise that can be derived from the aforementioned description. That is to say, the present invention is not restricted to a specific circuit configuration. Specific description will be made below regarding an example configuration for clarification and ease of understanding of the essence of the present invention and the circuit operation. That is to say, the following description will by no means be intended to restrict the technical scope of the present invention.

Figure 6A:
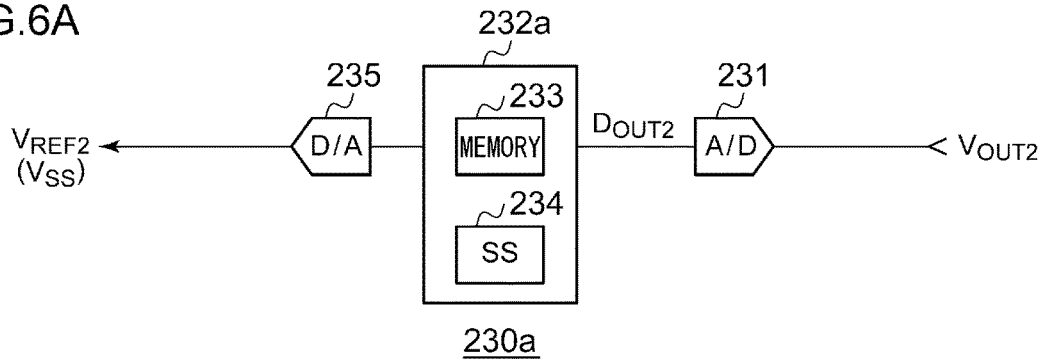
FIGS. 6A through 6C are circuit diagrams each showing an example configuration of a reference voltage setting unit.
Figure 6B:
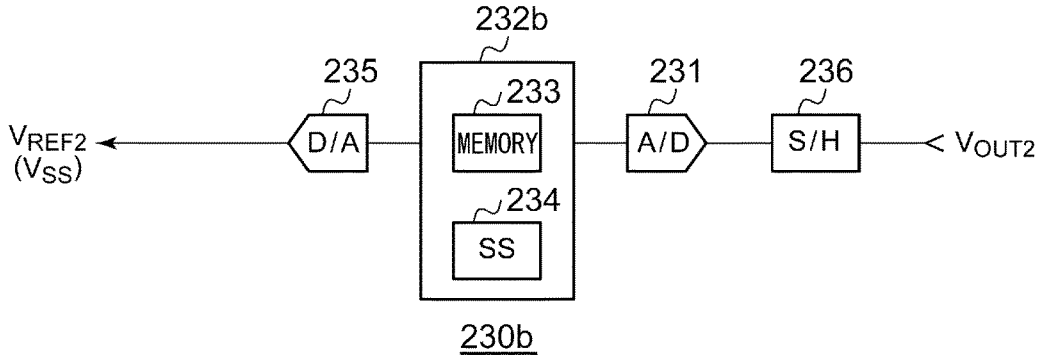
Figure 6C:
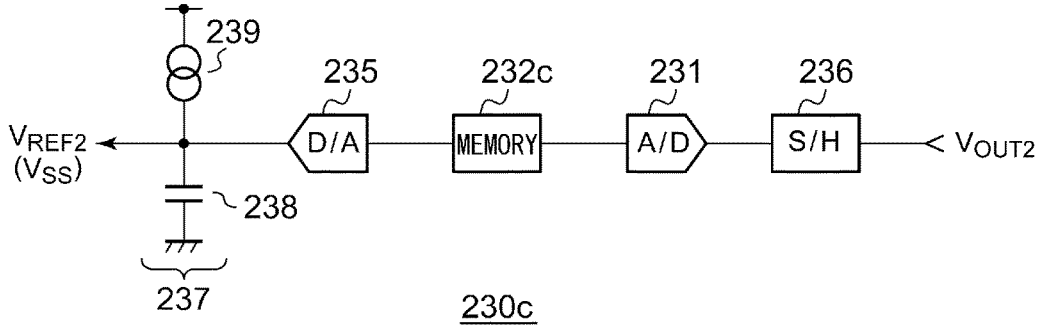

FIGS. 6A through 6C are circuit diagrams each showing an example configuration of the reference voltage setting unit 230. A reference voltage setting unit 230*a* shown in FIG. 6A includes an A/D converter 231, a digital circuit 232*a*, and a D/A converter 235. In the calibration period $T_{CAL}$, the A/D converter 231 converts the second detection voltage $V_{OUT2}$ into a digital value $D_{OUT2}$. The digital circuit 232*a* holds the maximum value $D_{OUT2_MAX}$ of the digital value $D_{OUT2}$ in the calibration period $T_{CAL}$, and stores the maximum value $D_{OUT2_MAX}$ thus obtained in memory 233. In the normal lighting period $T_{NORM}$, the D/A converter 235 converts the digital value $D_{OUT2_MAX}$ stored in the memory 233 into the second reference voltage $V_{REF2}$ configured as an analog signal. Furthermore, in the soft-start period $T_{SS}$, the soft-start circuit 234 generates a digital soft-start signal that is gradually increased with the passage of time. The D/A converter 235 converts the soft-start signal thus generated into a soft-start voltage $V_{SS}$ configured as an analog signal.

A reference voltage setting unit 230*b* shown in FIG. 6B includes a sample-and-hold circuit 236 arranged as an upstream stage of the A/D converter 231. In the calibration period $T_{CAL}$, the sample-and-hold circuit 236 samples and holds the maximum value $V_{OUT2_MAX}$ of the second detection voltage $V_{OUT2}$. The sample-and-hold circuit 236 may have a peak hold configuration. The A/D converter 231 converts the maximum value $V_{OUT2_MAX}$ into a digital value $D_{OUT2_MAX}$, and stores the digital value $D_{OUT2_MAX}$ in the memory 233.

In a reference voltage setting unit 230*c* shown in FIG. 6C, a digital circuit 232*c* does not include the soft-start circuit 234. Instead, as a downstream stage of the D/A converter 235, an analog soft-start circuit 237 is provided. The soft-start circuit 237 includes a capacitor 238 and a current source 239 that charges the capacitor 238 in the soft-start period $T_{SS}$. In addition to the configurations shown in FIGS. 6A through 6C, various kinds of configurations may be employed for the reference voltage setting unit 230, which is conceivable by those skilled in this art.

SECOND EMBODIMENT

With the first embodiment, in the normal lighting period $T_{NORM}$ after the calibration period $T_{CAL}$, the error signal generating unit 220 is fixed to the second state ϕ2 in which the output voltage $V_{OUT}$ is maintained at a constant level. In contrast, with the second embodiment, in the normal lighting period $T_{NORM}$, the control logic 240 operates while dynamically and adaptively switching the error signal generating unit 220 between the first state ϕ1 and the second state ϕ2.

More specifically, in a case in which there is a small fluctuation in the output voltage $V_{OUT}$ if the first state ϕ1 is selected in the normal lighting period $T_{NORM}$, the control logic 240 instructs the error signal generating unit 220 to operate in the first state ϕ1 even in the normal lighting period $T_{NORM}$.

Figure 7A:
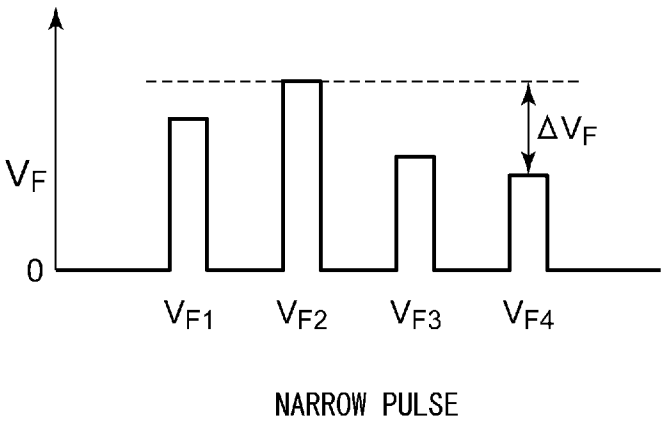
FIG. 7A is a diagram showing the forward voltages $V_F$ of multiple LED bars when the dimming pulses $S_{DIM}$ each have a narrow pulse width.
Figure 7B:
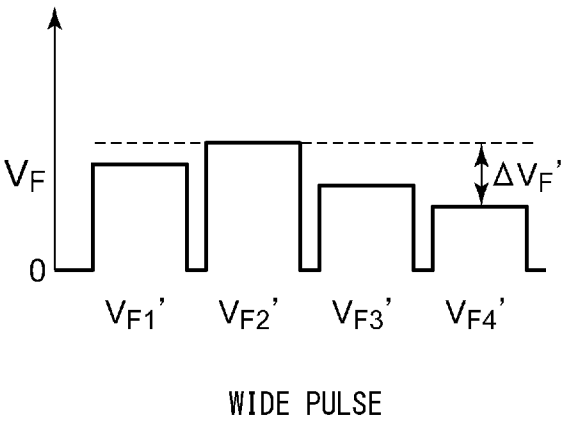
FIG. 7B is a diagram showing the forward voltages $V_F$ of multiple LED bars when the dimming pulses $S_{DIM}$ each have a wide pulse width.

FIG. 7A is a diagram showing the forward voltages $V_F$ of the multiple LED bars when the dimming pulses $S_{DIM}$ each have a narrow pulse width. FIG. 7B is a diagram showing such forward voltages $V_F$ when the dimming pulses $S_{DIM}$ each have a wide pulse width. In a transient state, the forward voltage $V_F$ of each LED depends on the duty ratio (pulse width) of the dimming pulse $S_{DIM}$. In some cases, as the duty ratio becomes smaller, the forward voltage $V_F$ becomes larger. Conversely, as the duty ratio becomes larger, the forward voltage $V_F'$ becomes smaller.

With such an arrangement, when there is a small difference $\Delta V_F$ among the forward voltages $V_F$, this leads to a small fluctuation in the output voltage $V_{OUT}$ even if the output voltage $V_{OUT}$ is adjusted in the first state ϕ1 of the error signal generating unit 220. Thus, such an arrangement does not require a high response speed. As shown in FIG. 7B, when the dimming pulses $S_{DIM}$ each have a certain large duty ratio, this leads to a small fluctuation $\Delta V'$ in the output voltage $V_{OUT}$. Thus, in the second embodiment, the control logic 240 instructs the error signal generating unit 220 to switch between the first state ϕ1 and the second state ϕ2 according to the duty ratios (pulse widths) of the multiple dimming pulses $S_{DIM1}$ through $S_{DIMN}$.

For example, when the smallest duty ratio from among the duty ratios of the multiple dimming pulses $S_{DIM1}$ through $S_{DIMN}$ is larger than a predetermined threshold value (e.g., 50%), the error signal generating unit 220 is set to the first state ϕ1. In this state, the output voltage $V_{OUT}$ is changed from moment to moment according to the on/off operations of the current drivers 22_1 through 22_N. It should be noted that the threshold value may preferably be determined based on the transient response characteristics of each diode.

Conversely, when the smallest duty ratio is smaller than the threshold value, i.e., when there is a large difference $\Delta V_F$ among the forward voltages $V_F$ of the multiple LED bars 10, the error signal generating unit 220 is set to the second state ϕ2. In this state, the output voltage $V_{OUT}$ is maintained at a constant voltage level regardless of the on/off operations of the current drivers 22_1 and 22_N.

Figure 8:
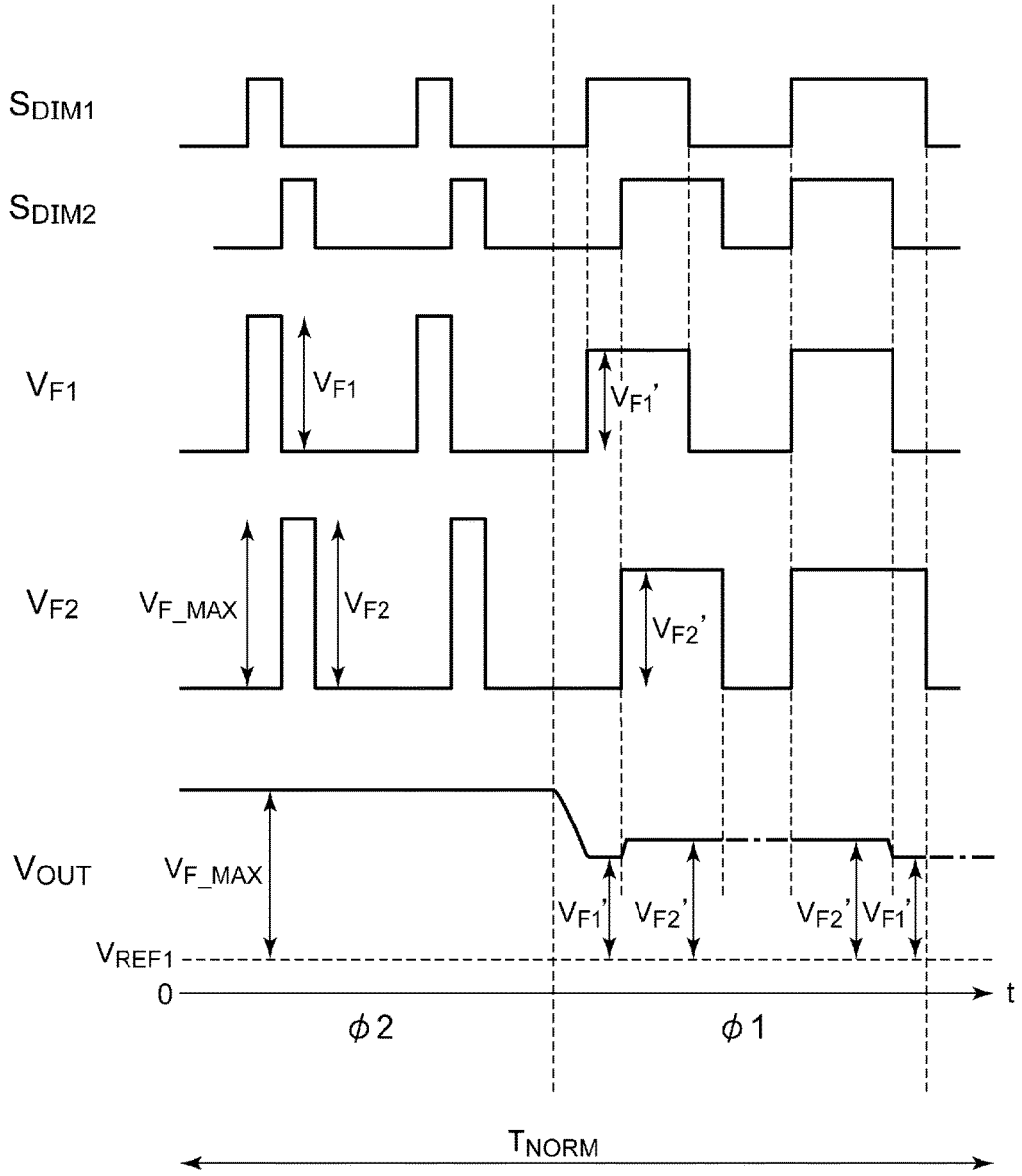
FIG. 8 is an operation waveform diagram showing the operation of an illumination apparatus according to a second embodiment in a normal lighting period.

FIG. 8 is an operation waveform diagram showing the operation in the normal lighting period of the illumination apparatus 2 according to the second embodiment. For ease of understanding, description will be made regarding an arrangement having two channels. In the first half-part section of the waveform, the lowest duty ratio from among the duty ratios of the multiple dimming pulses $S_{DIM1}$ through $S_{DIMN}$ is smaller than a predetermined threshold value (e.g., 50%). This leads to a large forward voltage $V_F$ for each channel. Furthermore, this leads to a large difference $\Delta V_F = V_{F2} - V_{F1}$. Thus, in this case, the error signal generating unit 220 is operated in the second state ϕ2 so as to maintain the output voltage $V_{OUT}$ at a constant voltage level. This prevents a situation in which an LED bar cannot turn on due to a response delay.

In the second half-part section of the waveform, the lowest duty ratio from among the duty ratios of the multiple dimming pulses $S_{DIM1}$ through $S_{DIMN}$ is larger than a predetermined threshold value (e.g., 50%). This leads to a small forward voltage $V_F$ for each channel. Furthermore, this leads to a small difference $\Delta V_F' = V_{F2}' - V_{F1}'$. Thus, in this case, the error signal generating unit 220 is operated in the first state ϕ1 so as to adjust the output voltage $V_{OUT}$.

With the second embodiment, such an arrangement may operate in the first state ϕ1 even in the normal lighting period $T_{NORM}$, thereby providing improved efficiency.

Figure 1:
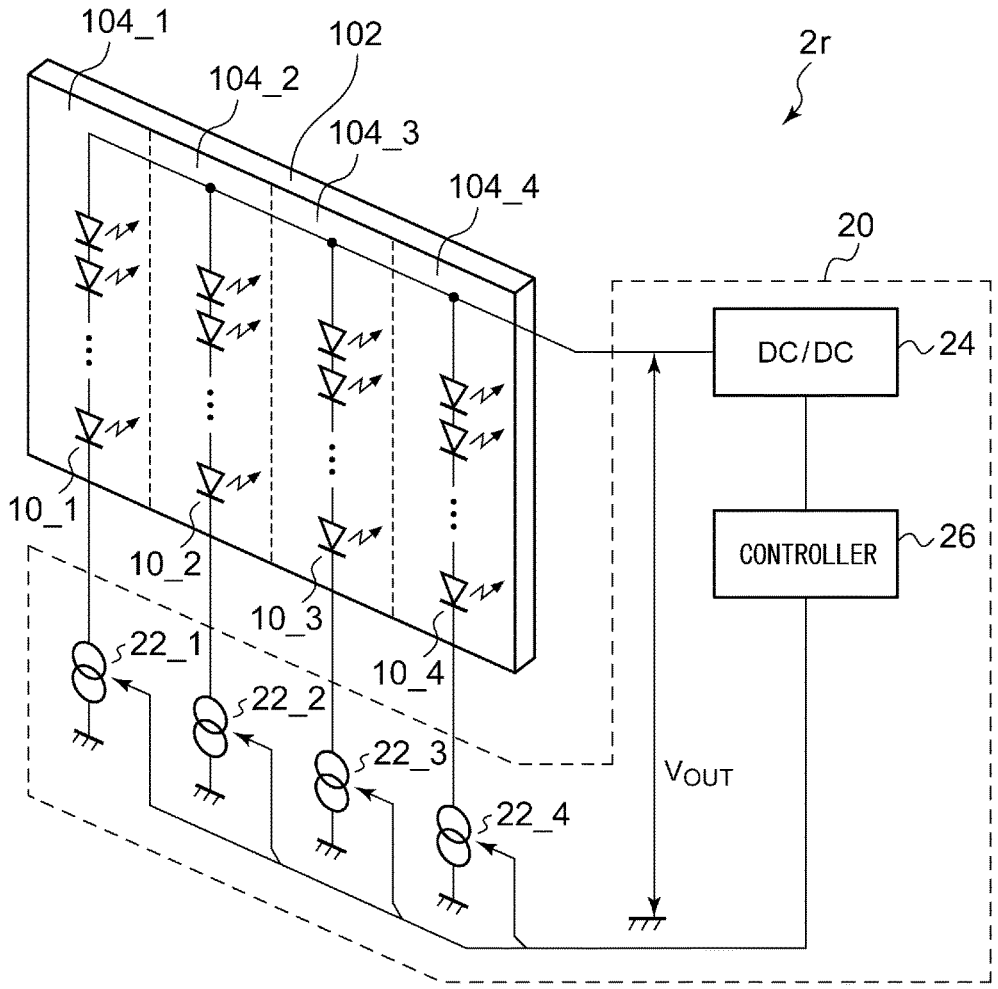
FIG. 1 is a diagram showing an illumination apparatus for use as a backlight investigated by the present inventors.
Figure 2:
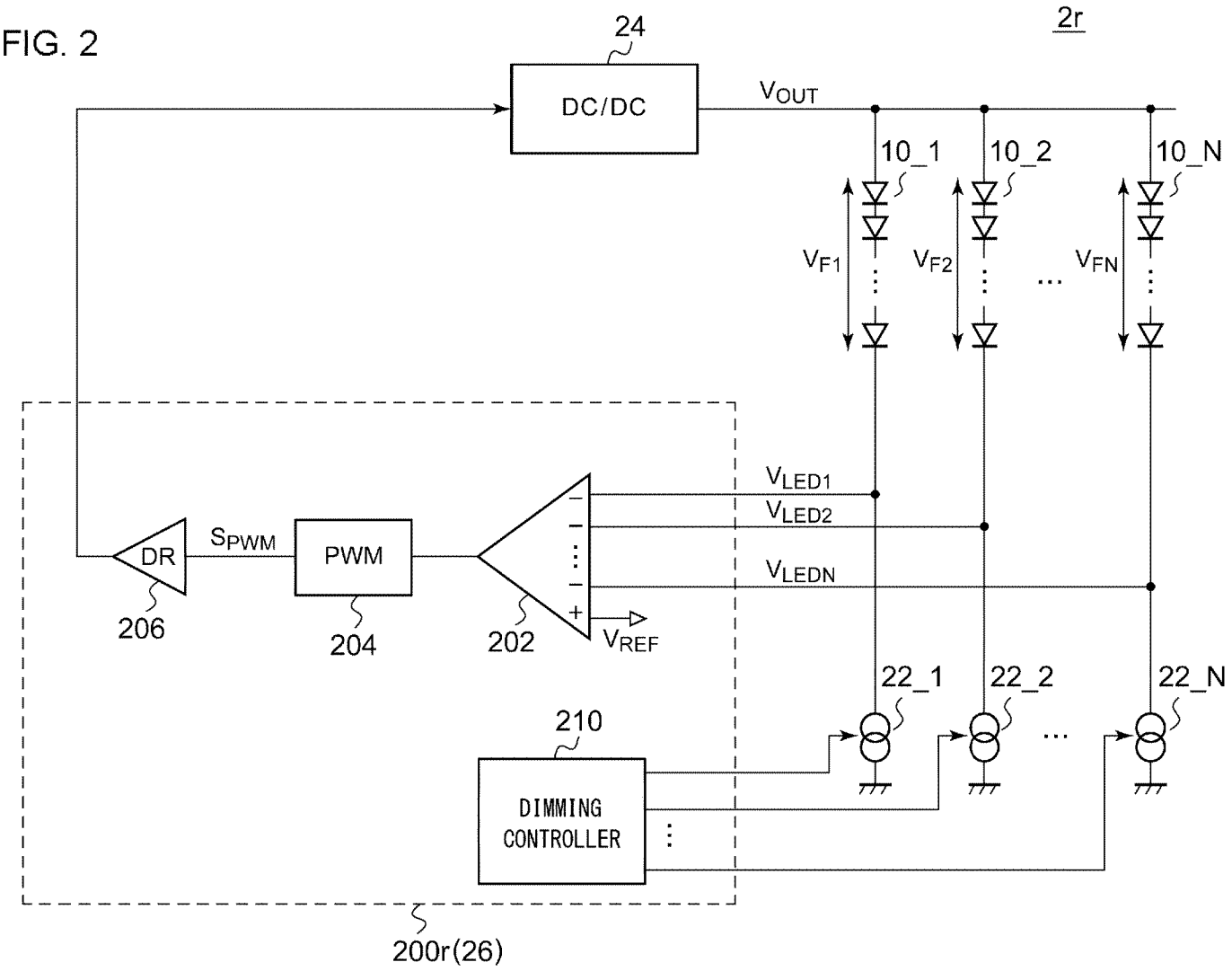
FIG. 2 is a circuit diagram showing a conventional illumination apparatus.
Figure 3:
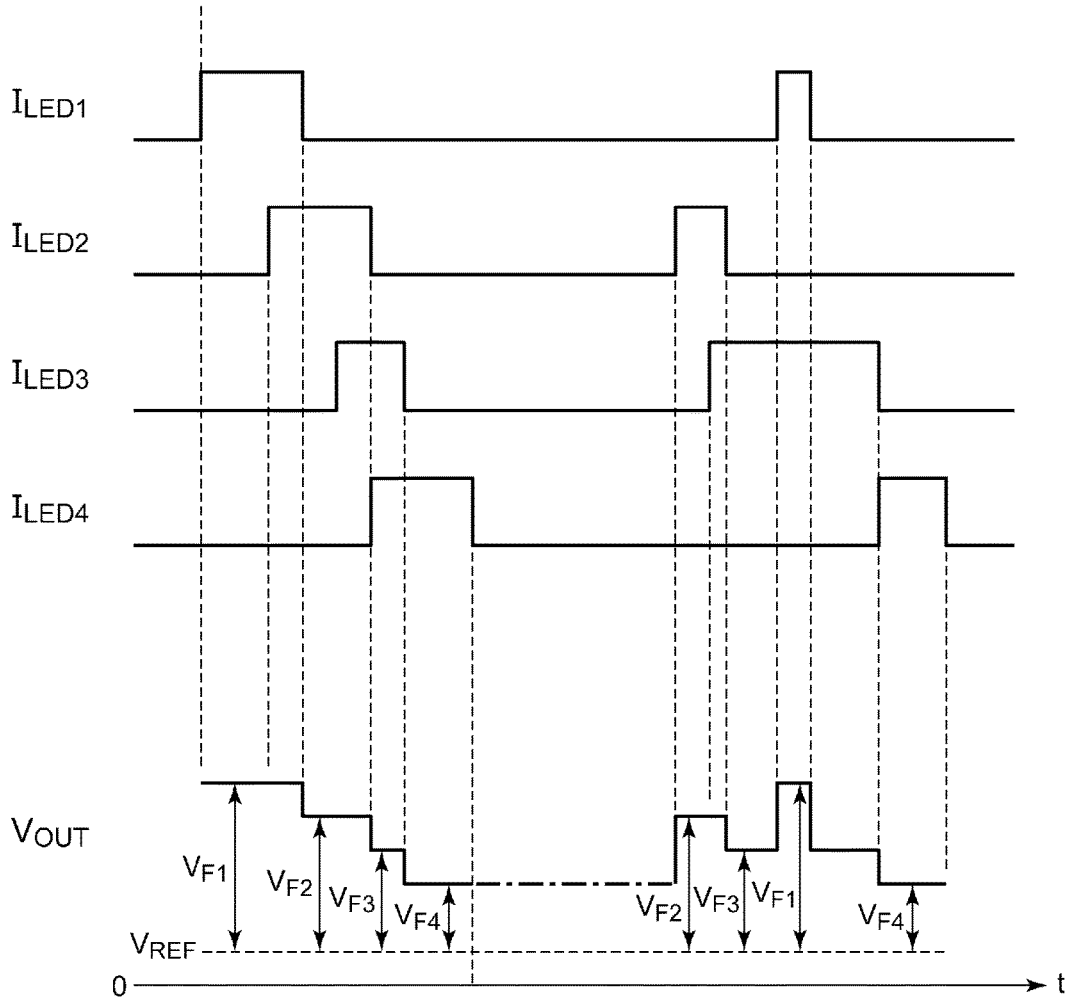
FIG. 3 is an operation waveform diagram showing the operation of a control circuit in a case in which it performs an individual area dimming control operation.
Figure 9A:
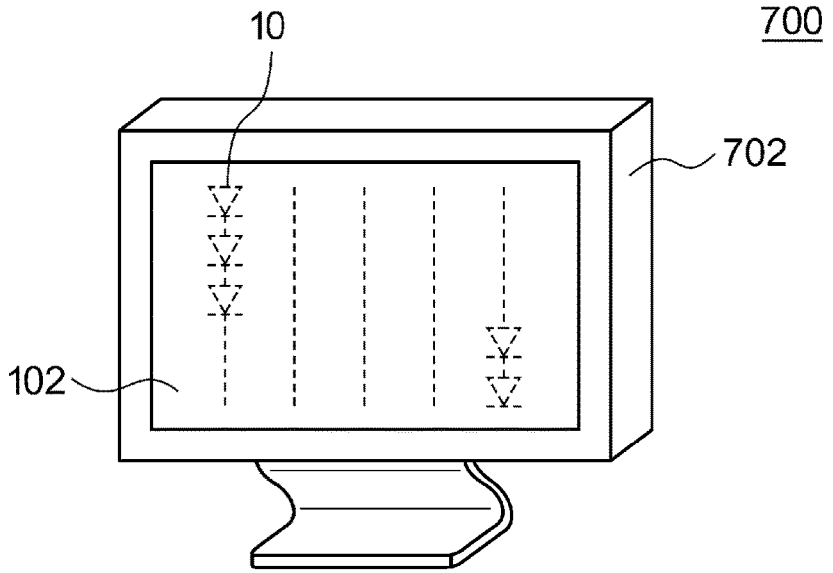
FIGS. 9A and 9B are diagrams each showing an example of an electronic device including the illumination apparatus shown in FIG. 4.
Figure 9B:
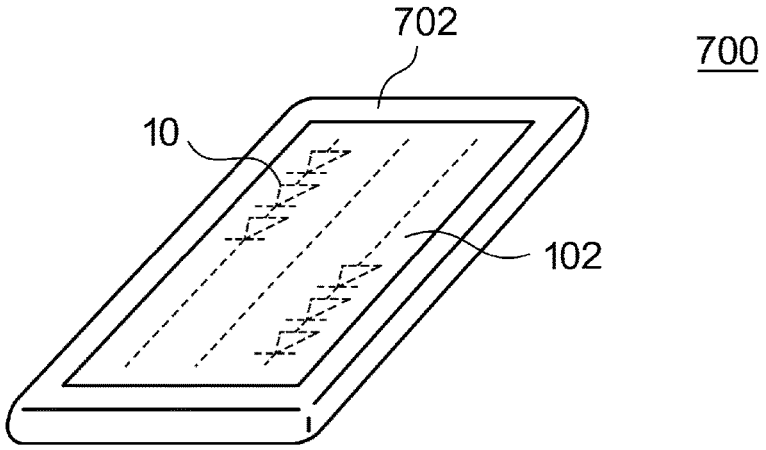

Next, description will be made regarding the usage of the illumination apparatus 2. FIGS. 9A and 9B are diagrams each showing an example of an electronic device including the direct-type illumination apparatus 2 shown in FIG. 4. An electronic device 700 shown in FIG. 9A is configured as a display apparatus such as a TV, car navigation system, PC, or the like. The electronic device 700 shown in FIG. 9B is configured as a tablet PC, PDA (Personal Digital Assistant), cellular phone terminal, or the like. The electronic device 700 includes a housing 702 and an LCD panel 102. Each LED bar 10 is arranged as a backlight on the back face of the LCD panel 102. Instead of such a direct-type illumination apparatus 2, such an electronic device may mount the edge-light type illumination apparatus 2 as shown in FIG. 3.

Description has been made above regarding the present invention with reference to the embodiment. The above-described embodiment has been described for exemplary purposes only, and is by no means intended to be interpreted restrictively. Rather, it can be readily conceived by those skilled in this art that various modifications may be made by making various combinations of the aforementioned components or processes, which are also encompassed in the technical scope of the present invention. Description will be made below regarding such modifications.

[First Modification]

Description has been made in the first embodiment regarding an arrangement in which, in the calibration period $T_{CAL}$, the multiple dimming pulses $S_{DIM1}$ through $S_{DIMN}$ are switched to the high level at the same time (i.e., the current drivers 22 are turned on at the same time) as shown in FIG. 5. However, the present invention is not restricted to such an arrangement. Also, the multiple dimming pulses $S_{DIM1}$ through $S_{DIMN}$ may be sequentially switched to the on level in an exclusive manner. As with the first embodiment, in this case, the largest value of the second detection voltage $V_{OUT2}$ may preferably be used as the second reference voltage $V_{REF2}$. For example, the reference voltage setting unit 230 may be configured using a peak hold circuit.

[Second Modification]

In the second embodiment, the reference voltage setting unit 230 may be omitted. In this modification, the predetermined voltage $\hat{V}_{REF2}$ described as a comparison technique may be used as the second reference voltage $V_{REF2}$. In this case, such a modification provides worsened efficiency as compared with the second embodiment. However, such a modification switches its state between the first state ϕ1 and the second state ϕ2 in the normal lighting period $T_{NORM}$, thereby providing improved efficiency.

[Third Modification]

The configuration of the error signal generating unit 220 is not restricted to that shown in FIG. 4. The first error amplifier 222 and the second error amplifier 224 may be configured as a single shared error amplifier. In this modification, the selector 226 may be omitted. Instead, as an input stage of the error amplifier, a selector (switch circuit) may preferably be provided so as to switch the reference voltage between $V_{REF1}$ and $V_{REF2}$ and to switch the detection voltage between $V_{OUT2}$ and $V_{LED1}$ through $V_{LEDN}$.

[Fourth Modification]

Description has been made in the embodiments regarding an arrangement in which all the LED bars 10 are each configured comprising the same light-emitting elements (white-color LEDs). However, the present invention is not restricted to such an arrangement. For example, a given LED bar 10 may include red-color LEDs, another given LED bar 10 may include green-color LEDs, and yet another given LED bar 10 may include blue-color LEDs. Such an arrangement leads to a further increase in the difference in the forward voltage $V_F$ among the channels. Thus, the present invention is more effectively applicable to such a modification. The kind of such a light-emitting element is not restricted to an LED. Also, the present invention is applicable to organic EL devices and various kinds of other semiconductor light sources.

[Fifth Modification]

The usage of the illumination apparatus 2 is not restricted to a backlight for a liquid crystal display. Also, the present invention is applicable to electric decoration devices, etc.

While the preferred embodiments of the present invention have been described using specific terms, such description is for illustrative purposes only, and it is to be understood that changes and variations may be made without departing from the spirit or scope of the appended claims.

What is claimed is:

1. A control circuit for an illumination apparatus, wherein the illumination apparatus comprises:

a switching converter that generates an output voltage at an output line thereof;

a plurality of light-emitting elements each having one end connected to the output line of the switching converter;

a plurality of current drivers that respectively correspond to the plurality of respective light-emitting elements, and each of which is connected to the other end of a corresponding light-emitting element; and the control circuit that controls the switching converter based on a plurality of first detection voltages each of which occurs at the other end of the corresponding one of the plurality of light-emitting elements and a second detection voltage that corresponds to the output voltage at the output line, and wherein the control circuit comprises:

an error signal generating unit configured such that (i) in a calibration period, the error signal generating unit is set to a first state in which a difference between a predetermined first reference voltage and a lowest from among the plurality of first detection voltages is amplified so as to generate an error signal, and such that (ii) after the calibration period ends, a difference between the second detection voltage and a second reference voltage is amplified so as to generate the error signal;

a pulse modulator that generates a pulse signal according to the error signal;

a driver that drives the switching converter according to the pulse signal;

a dimming controller that generates a plurality of pulse modulated dimming pulses, so as to control on/off operations of the plurality of current drivers according to the plurality of dimming pulses; and a reference voltage setting unit that determines the second reference voltage according to a largest value of the second detection voltage detected in the calibration period.

2. The control circuit according to claim 1, wherein, in the calibration period, the dimming controller generates the plurality of dimming pulses each having a duty ratio that provides the corresponding light-emitting element with a maximum forward voltage.

3. The control circuit according to claim 1, wherein, in the calibration period, the dimming controller generates the plurality of dimming pulses so as to turn on the plurality of light-emitting elements at the same time.

4. The control circuit according to claim 1, wherein, after the calibration period ends, the error signal generating unit is switchable between the first state and the second state.

5. The control circuit according to claim 4, wherein, after the calibration period ends, the error signal generating unit is selectively set to one from among the first state and the second state according to the duty ratios of the plurality of dimming pulses.

6. The control circuit according to claim 4, wherein, when a smallest duty ratio from among the duty ratios of the plurality of dimming pulses is larger than a predetermined threshold value, the error signal generating unit is set to the first state, and wherein, when the smallest duty ratio is smaller than the threshold value, the error signal generating unit is set to the second state.

7. The control circuit according to claim 1, wherein the error signal generating unit comprises:

a first error amplifier that amplifies a difference between the first reference voltage and a lowest voltage from among the plurality of first detection voltages, so as to generate a first error signal;

a second error amplifier that amplifies a difference between the second detection voltage and the second reference voltage, so as to generate a second error signal; and a selector that receives the first error signal and the second error signal, that selects the first error signal in the calibration period, and that selects the second error signal after the calibration period ends.

8. The control circuit according to claim 1, monolithically integrated on a single semiconductor substrate.

9. An illumination apparatus comprising the control circuit according to claim 8.

10. The illumination apparatus according to claim 9, wherein the plurality of light-emitting elements are each configured as a light-emitting diode string comprising a plurality of light-emitting diodes connected in series.

11. A display apparatus comprising:

a liquid crystal panel; and the illumination apparatus according to claim 9, configured as a backlight for the liquid crystal panel.

12. A control circuit for an illumination apparatus, wherein the illumination apparatus comprises:

a switching converter that generates an output voltage at an output line thereof;

a plurality of light-emitting elements each having one end connected to the output line of the switching converter;

a plurality of current drivers that respectively correspond to the plurality of respective light-emitting elements, and each of which is connected to the other end of a corresponding light-emitting element; and the control circuit that controls the switching converter based on a plurality of first detection voltages each of which occurs at the other end of the corresponding one of the plurality of light-emitting elements and a second detection voltage that corresponds to the output voltage at the output line, wherein the control circuit comprises:

an error signal generating unit that is switchable between (i) a first state in which a difference between a predetermined first reference voltage and a lowest from among the plurality of first detection voltages is amplified so as to generate an error signal, and (2) a second state in which a difference between the second detection voltage and a second reference voltage is amplified so as to generate the error signal;

a pulse modulator that generates a pulse signal according to the error signal;

a driver that drives the switching converter according to the pulse signal; and a dimming controller that generates a plurality of pulse modulated dimming pulses, so as to control on/off operations of the plurality of current drivers according to the plurality of dimming pulses, and wherein, in a normal lighting period, the error signal generating unit is selectively set to one from among the first state and the second state according to the duty ratios of the plurality of dimming pulses.

13. The control circuit according to claim 12, wherein, when a smallest duty ratio from among the duty ratios of the plurality of dimming pulses is larger than a predetermined threshold value, the error signal generating unit is set to the first state, and wherein, when the smallest duty ratio is smaller than the threshold value, the error signal generating unit is set to the second state.

14. The control circuit according to claim 12, wherein, (i) in a calibration period, the error signal generating unit is set to the first state, and wherein the control circuit further comprises a reference voltage setting unit that holds, as the second reference voltage, a largest value of the second detection voltage detected in the calibration period.

15. The control circuit according to claim 12, monolithically integrated on a single semiconductor substrate.

16. An illumination apparatus comprising the control circuit according to claim 12.

17. The illumination apparatus according to claim 16, wherein the plurality of light-emitting elements are each configured as a light-emitting diode string comprising a plurality of light-emitting diodes connected in series.

18. A display apparatus comprising:

a liquid crystal panel; and the illumination apparatus according to claim 16, configured as a backlight for the liquid crystal panel.

19. A control method for an illumination apparatus, wherein the illumination apparatus comprises:

a switching converter that generates an output voltage at an output line thereof;

a plurality of light-emitting elements each having one end connected to the output line of the switching converter;

a plurality of current drivers that respectively correspond to the plurality of respective light-emitting elements, and each of which is connected to the other end of a corresponding light-emitting element; and a control circuit that controls the switching converter based on a plurality of first detection voltages each of which occurs at the other end of the corresponding one of the plurality of light-emitting elements and a second detection voltage that corresponds to the output voltage at the output line, and wherein the control method comprises:

(i) in a calibration period, generating a first error signal by amplifying a difference between a predetermined first reference voltage and a lowest from among the plurality of first detection voltages;

in the calibration period, generating a first pulse signal that is pulse modulated according to the error signal;

in the calibration period, driving the switching converter according to the first pulse signal;

in the calibration period, generating a plurality of dimming pulses, and controlling on/off operations of the plurality of current drivers according to the plurality of dimming pulses;

holding, as the second reference voltage, a largest value of the second detection voltage detected in the calibration period;

after the calibration period, generating a second error signal by amplifying the second detection voltage and the second reference voltage;

after the calibration period, generating a second pulse signal that is pulse modulated according to the second error signal; and after the calibration period, driving the switching converter according to the second pulse signal.

20. A control method for an illumination apparatus, wherein the illumination apparatus comprises:

a switching converter that generates an output voltage at an output line thereof;

a plurality of light-emitting elements each having one end connected to the output line of the switching converter;

a plurality of current drivers that respectively correspond to the plurality of respective light-emitting elements, and each of which is connected to the other end of a corresponding light-emitting element; and a control circuit that controls the switching converter based on a plurality of first detection voltages each of which occurs at the other end of the corresponding one of the plurality of light-emitting elements and a second detection voltage that corresponds to the output voltage at the output line, and wherein the control method comprises:

in a normal lighting period, generating a plurality of dimming pulses that are pulse modulated according to a target luminance set for the plurality of light-emitting elements, and controlling on/off operations of the plurality of current drivers according to the plurality of dimming pulses;

in a first state, generating an error signal by amplifying a difference between a predetermined first reference voltage and a lowest voltage from among the plurality of first detection voltages;

in a second state, generating the error signal by amplifying a difference between the second detection voltage and a second reference voltage;

generating a pulse signal that is pulse modulated according to the error signal;

driving the switching converter according to the pulse signal; and selecting one from among the first state and the second state according to duty ratios of the plurality of dimming pulses.

* * * * *